US005918300A

United States Patent [19]

Hsieh

[11] Patent Number: 5,918,300

[45] Date of Patent: Jun. 29, 1999

[54] DEVICE FOR LOCATING AND ADJUSTING A SET OF CYMBALS

[76] Inventor: Wu-Hong Hsieh, No. 46, Lane 59, Chungcheng Rd., Luchou Hsiang, Taipei Hsien, Taiwan

[21] Appl. No.: 08/987,303

[22] Filed: Dec. 9, 1997

[51] Int. Cl.[6] ..... G10D 13/02

[52] U.S. Cl. ..... 84/422.3; 84/402; 84/453; 248/346

[58] Field of Search ..... 84/422.1, 422.2, 84/422.3, 402, 402 A, 421, 453; 248/121, 125.2, 230.6, 346.1, 346.3

[56] References Cited

U.S. PATENT DOCUMENTS

| | | | |
|---|---|---|---|
| 1,879,496 | 9/1932 | Reussenzehn | 248/346 |
| 3,893,363 | 7/1975 | Cohen | 84/402 |
| 4,185,808 | 1/1980 | Donohoe et al. | 248/295 R |
| 4,274,322 | 6/1981 | Cordes | 84/422 R |
| 4,319,514 | 3/1982 | Donohoe | 84/421 |
| 4,526,083 | 7/1985 | Lemert | 84/421 |
| 5,063,819 | 11/1991 | Hoshino | 84/422.3 |
| 5,395,086 | 3/1995 | Goldstein | 248/346 |
| 5,808,217 | 9/1998 | Liao | 84/422.3 |

*Primary Examiner*—William M. Shoop, Jr.
*Assistant Examiner*—Wesley Scott Ashton
*Attorney, Agent, or Firm*—William E. Pelton, Esq.

[57] ABSTRACT

A device for locating and adjusting a set of cymbals includes a tri-lobic pedestal connected with a support frame of a cymbal device via a stanchion. The tri-lobic pedestal has a tubular post longitudinally extends substantially from a top face thereof. A resilient pad is mounted around the tubular post and rests on the top face of the tri-lobic pedestal. The resilient pad has three wings pieces formed therewith, each wing piece having a cambered upper surface for supporting a lower cymbal of the cymbal device. A tripod is mounted around the tubular post and between the resilient pad and a lower cymbal of the cymbal device to secure the resilient pad on the tri-lobic pedestal. The tri-lobic pedestal further defines a couterbore in the top face thereof and communicating with a screw hole thereof for receiving a nut in a non-rotatable condition, such that a screw extends therethrough and threadedly engages with the nut. When the screw is turned, it urges against one of the wings pieces of the resilient pad, thereby tilting the resilient pad and the lower cymbal for adjustment.

6 Claims, 5 Drawing Sheets

DEVICE FOR LOCATING AND ADJUSTING A SET OF CYMBALS

BACKGROUND OF THE INVENTION

1. Field of the Invention

The present invention relates to a device for locating and adjusting a set of cymbals, and more particularly to a device which allows the cymbals to be stably located and accurately adjusted and the vibration generated by operating the cymbals be effectively dampened.

2. Description of Related Art

Cymbals are commonly used in bands. A conventional device for locating and adjusting a set of cymbals generally includes a pedestal with a washer. One of the pair of cymbals is located on the washer and a bolt is extended upward through the pedestal for underpropping the washer, thereby adjusting an inclination of the cymbal.

This kind of device has a disadvantage that the location of the cymbal is unstable because the cymbal has an arcuate lower face and the washer has a plane face to contact with the arcuate lower face of the cymbal. A second drawback of the convention device lies in that the inclination of the cymbal can not be adjusted accurately.

The present invention provides an improved device for locating and adjusting cymbals to mitigate and/or obviate the aforementioned problems.

SUMMARY OF THE INVENTION

One object of the present invention is to provide a device which allows the set of cymbals to be stably located and accurately adjusted.

Another object of the present invention is to provide a device for locating and adjusting a set of cymbals. which can effectively damp the vibration generated by operating the cymbals.

Other objects, advantages and novel features of the invention will become more apparent from the following detailed description when taken in conjunction with the accompanying drawings.

DETAILED DESCRIPTION OF PREFERRED EMBODIMENT

Figure 1:
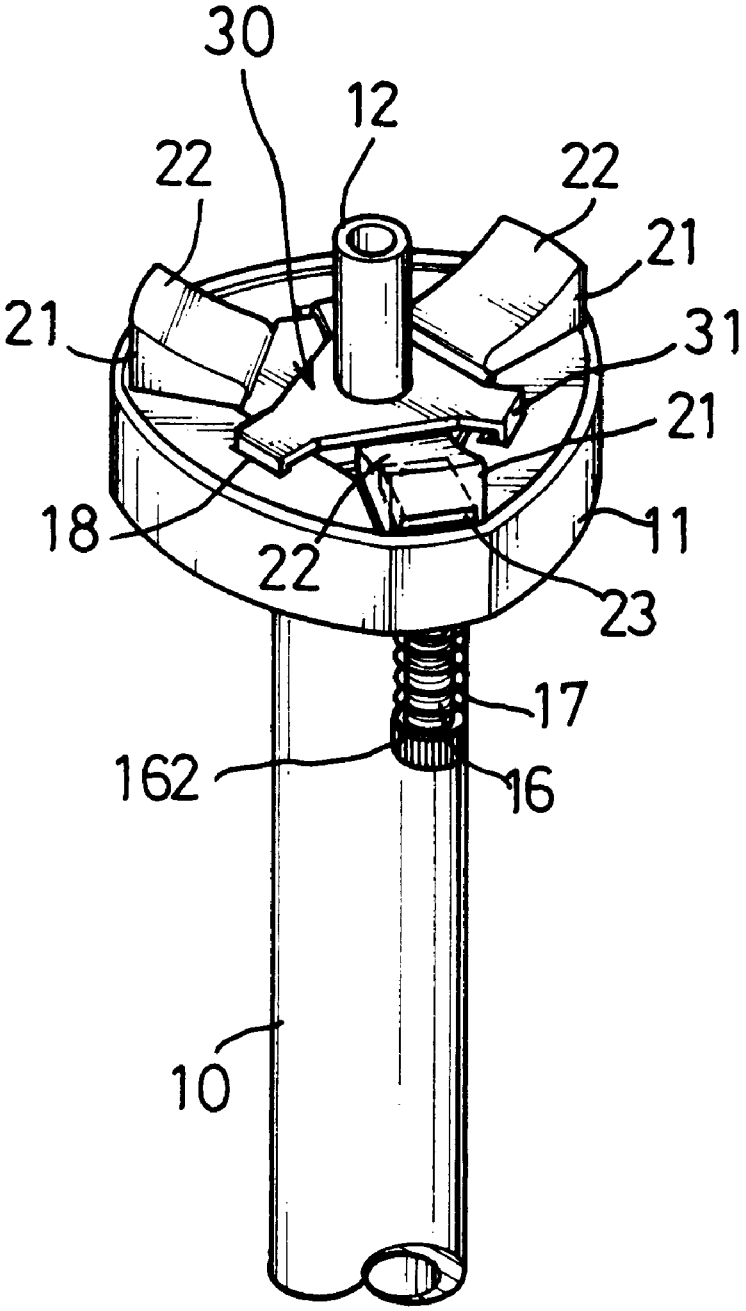
FIG. 1 is a perspective view showing a device for locating and adjusting a set of cymbals in accordance with the present invention.
Figure 2:
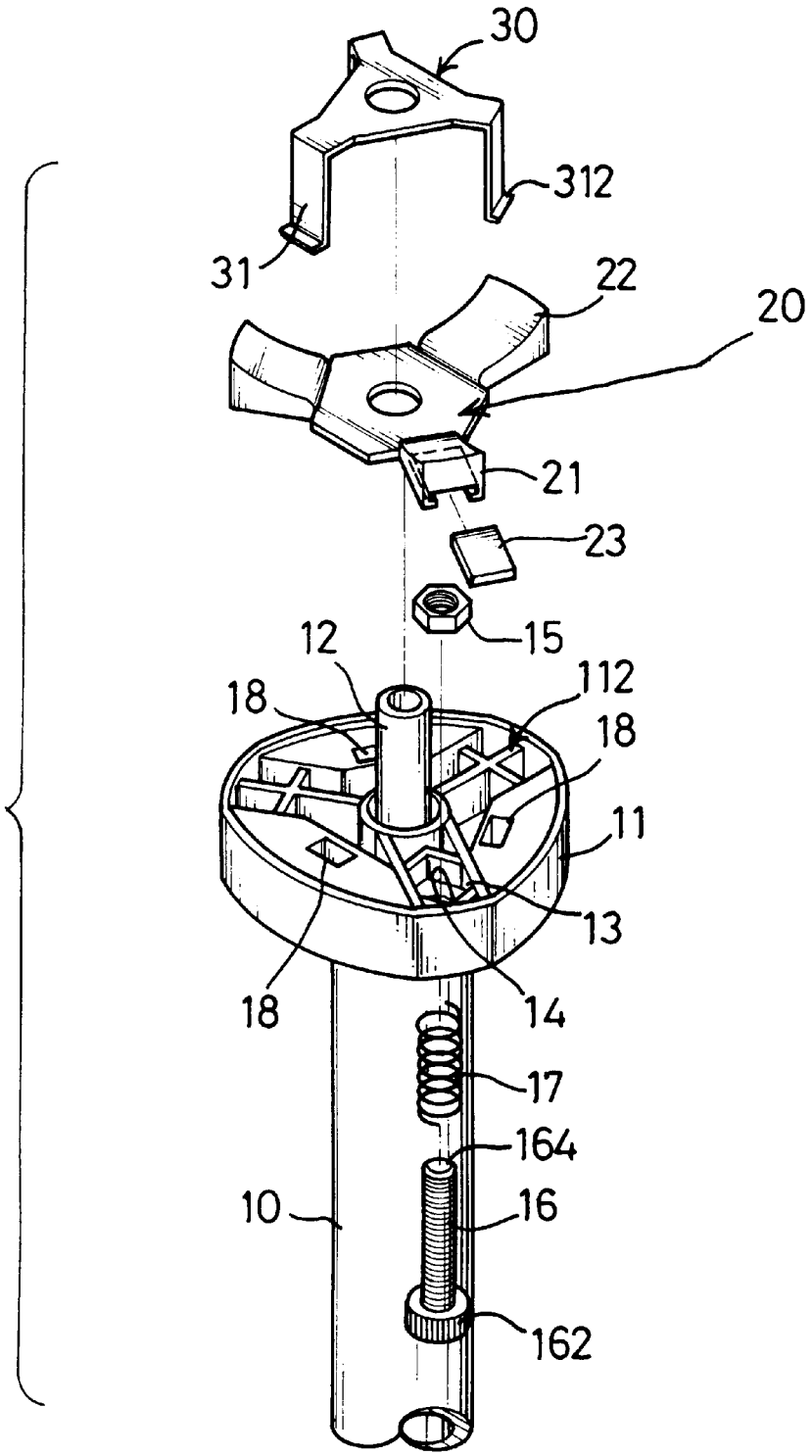
FIG. 2 is an exploded perspective view showing the device for locating and adjusting a set of cymbals of FIG. 1
Figure 3:
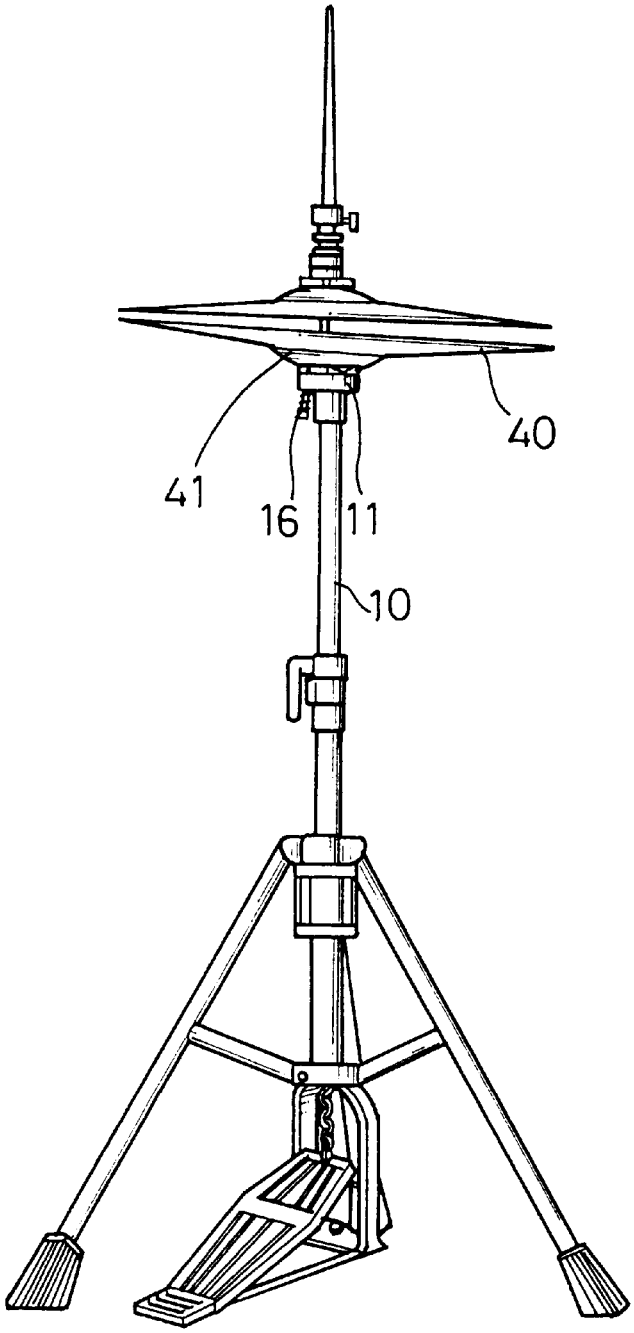
FIG. 3 is a perspective view showing a cymbal device.

Referring to FIG. 1 and FIG. 2, a device for locating and adjusting a set of cymbals in accordance with the present invention includes a stanchion 10 which is part of a support frame of a cymbal device (not numbered and as shown in FIG. 3). The set of cymbals comprises a lower cymbal 40 and an upper cymbal (not numbered).

A first end of the stanchion 10 is integrally formed as a tri-lobic pedestal 11 and a second end thereof is received in the support frame. A tubular post 12 longitudinally extends substantially from a top face 112 of the tri-lobic pedestal 11. A screw hole 14 extends longitudinally and off-centrally through the tri-lobic pedestal 11 and communicates with a counterbore 13 defined in the top face 112. The counterbore 13 is sized to received therein a nut 15 in a non-rotatable condition. A screw 16 with a large head 162 at a first end and a tip 164 at a second end extends from a bottom face 114 of the tri-lobic pedestal 11 (see FIG. 4) such that the tip 164 threadedly engages with the nut 15 received in the counterbore 13. A coil spring 17 is mounted around the screw 16 between the large head 162 and the bottom face 114 of the tri-lobic pedestal 11. The tri-lobic pedestal 11 further defines three equispaced slots 18 extending from the top face 112 to the bottom face 114.

A resilient pad 20 is mounted around the tubular post 12 and rests on the top face 112. The resilient pad 20 has three wings pieces 21 formed therewith, each wing piece 21 having a cambered upper surface 22 for supporting the lower cymbal 40. The resilient pad 20 is preferrably made of a dampening material in order to dampen vibration of the set of cymbals when they are played. Additionally, one of the three wing pieces 21 has a metal strip 23 received in a bottom face thereof. It is to be noted that as the resilient pad 20 is made of the dampening material, the metal strip 23 is provided as a rigid platform against which the tip 164 of the screw 16 can urge satisfactorily. The coil spring 17 prevents loosening of the screw 16.

The device for locating and adjusting the set of cymbals further includes a tripod 30 mounted around the tubular post 12 and between the resilient pad 20 and the lower cymbal 40. The tripod 30 has three hooks 312 respectively formed at a bottom of three legs 31 thereof. The legs 31 respectively extend through the three equi-spaced slots 18 until the hooks 3 12 engage against the bottom face 114 of the tri-lobic pedestal 11, thereby securing the resilient pad 20 on the tri-lobic pedestal 10. With reference to FIG. 3, the lower cymbal 40 is mounted around the tubular post 12 and has an arcuate lower face 41 mating with the cambered upper surfaces 22 of the resilient pad whereby the lower cymbal 40 is stably located.

Figure 4:
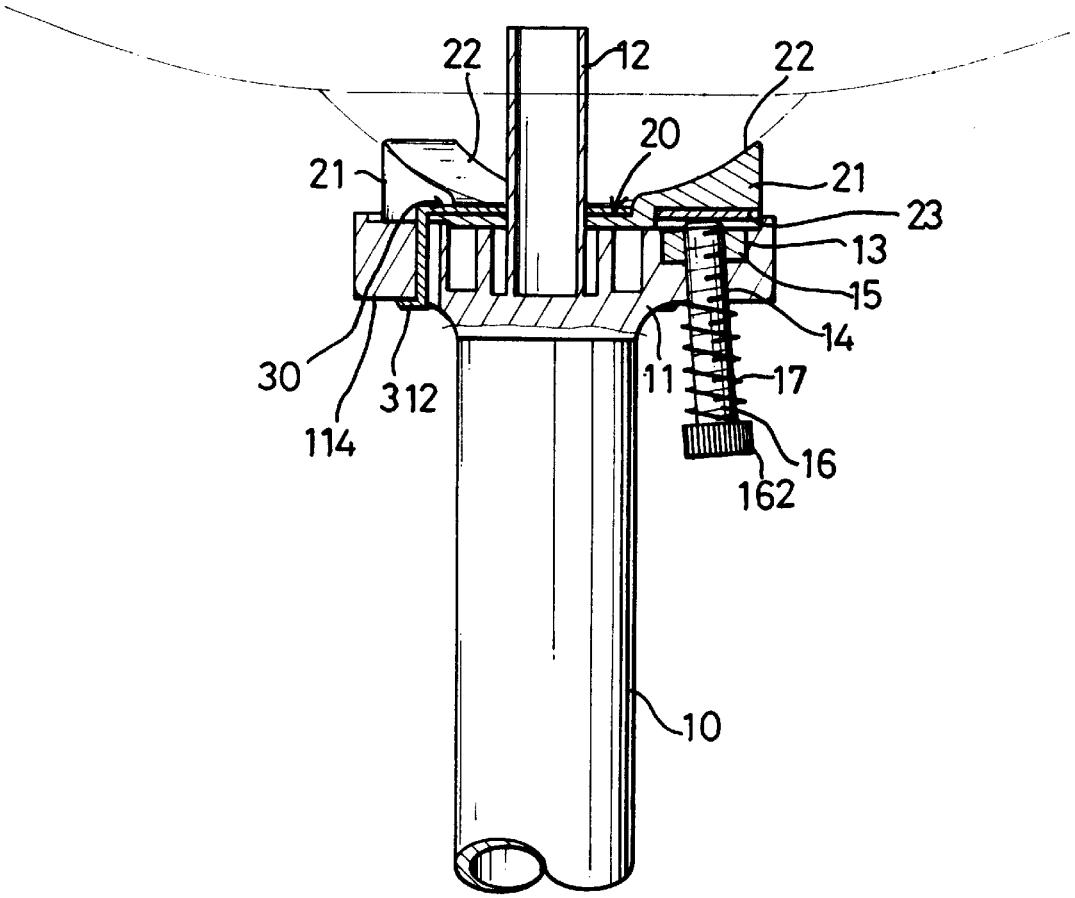
FIG. 4 is a sectional view showing a combined structure of the device for locating and adjusting cymbals in accordance with the present invention.
Figure 5:
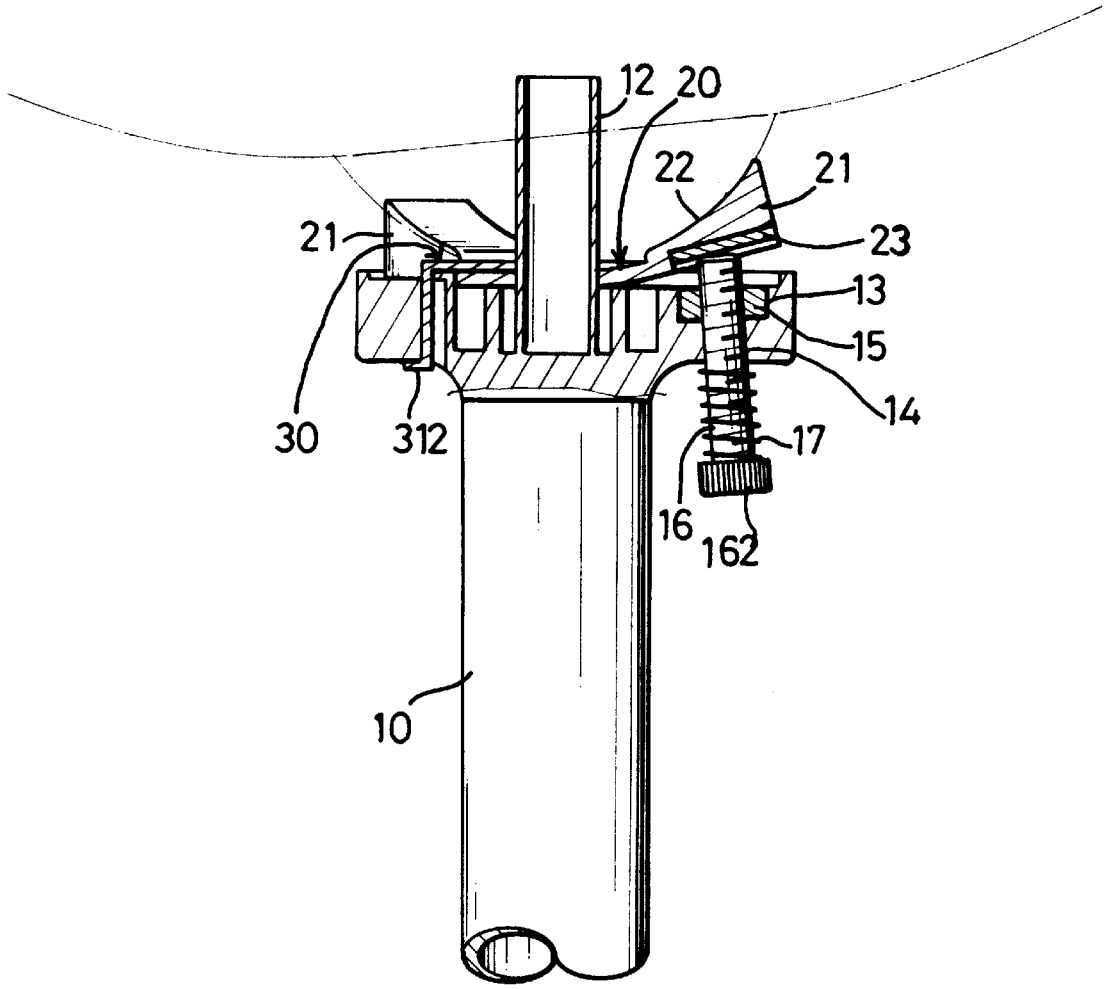
FIG. 5 is a sectional view showing the adjustment of one of the cymbals in accordance with the present invention.

Referring to FIGS. 4 and 5, when the lower cymbal 40 is to be accuratedly adjusted, the screw 1 6 is turned whereby the tip 164 projects beyond the top face 112 of the tri-lobic pedestal 11 and urges against the metal strip 23 and the according wing piece 21, thereby tilting the resilient pad 20 and the lower cymbal 40.

The upper cymbal is mounted to the tri-lobic pedestal 11 via the tubular post 12 in a conventional manner and thus not described in further detail here.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed:

1. A device for locating and adjusting a set of cymbals comprising:

a stanchion having a first end integrally formed as a multi-lobic pedestal and a second end received in a support frame of a cymbal device, said multi-lobic pedestal including:

a tubular post longitudinally extending substantially from a top face thereof;

a screw hole extending longitudinally and off-centrally therethrough;

a counterbore defined in the top face thereof and communicating with the screw hole for receiving a nut in a non-rotatable condition, such that a screw extends from a bottom face of the multi-lobic pedestal to threadedly engage with the nut; and a plurality of egui-spaced slots extending from the top face to a bottom face thereof;

the device further comprising a resilient pad mounted around the tubular post and resting on the top face of the multi-lobic pedestal, said resilient pad having a plurality of wing pieces formed therewith, each wing piece having a cambered upper surface for supporting a lower cymbal of the cymbal device; and a plate mounted around the tubular post and between the resilient pad and the lower cymbal, said plate having a plurality of hooks respectively formed at a bottom of a plurality of legs thereof. said legs respectively extending through the plurality of egui-spaced slots until the hooks engage against the bottom face of the multi-lobic pedestal, thereby securing the resilient pad on the multi-lobic pedestal.

2. A device for locating and adjusting a set of cymbals as claimed in claim 1, wherein said resilient pad is made of a dampening material in order to dampen vibration of the set of cymbals when they are played.

3. A device for locating and adjusting a set of cymbals as claimed in claim 1, wherein one of the plurality of wing pieces of the resilient pad has a metal strip received in a bottom face thereof to be provided as a rigid platform against which the screw can abut.

4. A device for locating and adjusting a set of cymbals as claimed in claim 1, wherein said screw has a coil spring mounted thereon to prevent loosening of the screw.

5. A Device for locating and adjusting a set of cymbals comprising:

a stanchion having a first end integrally formed as a tri-lobic pedestal and a second end received in a support frame of a cymbal device, said tri-lobic pedestal including:

a tubular post longitudinally extending substantially from a top face thereof;

a screw hole extending longitudinally and off-centrally therethrough;

a couterbore counterbore defined in the top face thereof and communicating with the screw hole for receiving a nut in a non-rotatable condition, such that a screw extends from a bottom face of the tri-lobic pedestal to threadedly engage with the nut; and three equi-spaced slots extending from the top face to a bottom face thereof;

the device further comprising a resilient pad mounted around the tubular post and resting on the top face of the tri-lobic pedestal, said resilient pad having three wing pieces formed therewith, each wing piece having a cambered upper surface for supporting a lower cymbal of the cymbal device; and a tripod mounted around the tubular post and between the resilient pad and the lower cymbal to secure the resilient pad on the tri-lobic pedestal; said tripod having three hooks respectively formed at a bottom of three legs thereof, said legs respectively extending through three equi-spaced slots until the hooks engage against the bottom face of the tri-lobic pedestal, thereby securing the resilient pad on the tri-lobic pedestal.

6. A device for locating and adjusting a set of cymbals as claimed in claim 5, wherein one of the three wing pieces of the resilient pad has a metal strip received in a bottom face thereof to be provided as a rigid platform against which the screw can abut.

* * * * *